United States Patent [19]

McNally

[11] 4,439,066

[45] Mar. 27, 1984

[54] PERVIOUS TUNNEL LINER MEMBER

[76] Inventor: Michael P. McNally, R.R. #1, Freelton, Ontario, Canada, L0R 1H0

[21] Appl. No.: 359,771

[22] Filed: Mar. 19, 1982

[51] Int. Cl.³ ..... E21D 11/00

[52] U.S. Cl. ..... 405/153; 52/169.5; 210/344; 405/151

[58] Field of Search ..... 405/150, 151, 152; 52/169.5, 302; 210/344, 473, 451

[56] References Cited

U.S. PATENT DOCUMENTS

| | | | |
|---|---|---|---|
| 3,387,711 | 6/1968 | Rickert | 210/344 |
| 3,474,909 | 10/1969 | Kearns | 210/344 X |
| 3,654,765 | 4/1972 | Healy et al. | 52/169.5 X |
| 3,929,648 | 12/1975 | Cuthbert | 210/453 X |
| 4,000,595 | 1/1977 | Fortescue | 52/302 |
| 4,045,964 | 9/1977 | Barclay | 52/169.5 X |

FOREIGN PATENT DOCUMENTS

| | | | |
|---|---|---|---|
| 238568 | 5/1959 | Australia | 210/344 |
| 926255 | 4/1955 | Fed. Rep. of Germany | 405/151 |
| 115493 | 7/1926 | Switzerland | 405/150 |
| 2057034 | 3/1981 | United Kingdom | 405/150 |
| 571618 | 9/1977 | U.S.S.R. | 405/150 |

*Primary Examiner*—Dennis L. Taylor

*Attorney, Agent, or Firm*—E. H. Oldham

[57] ABSTRACT

This invention discloses a prefabricated liner plate for lining the interior of a subterranean tunnel as a primary lining. The liner plate is formed in such a manner that an outer arcuate face has a depression formed therein so that a filter placed in the depression permits water flow therethrough, but prevents the passage of surrounding soil particles therethrough. Suitable conduit means allow any water which may pass through the filter to be bled through the liner plate and led out of the tunnel.

8 Claims, 3 Drawing Figures

PERVIOUS TUNNEL LINER MEMBER

BACKGROUND OF THE INVENTION

The construction of large underground tunnels is usually accomplished by removal of material at the tunnel face by machine (or otherwise) and subsequently lining the exposed tunnel surface with prefabricated liner members as the tunnel progresses through the ground. Usually, the tunnelling process will be assisted or in some instances made possible by the use of compressed air in the tunnel during the construction of the tunnel, as is usual in a plenum tunnelling process.

The above process has been in use since late in the nineteenth century and has been used successfully to drive tunnels through wide varieties of soil. If the soil through which the tunnel is being driven is impervious, the tunnel driving process is quite straightforward, and a minimum of air pressure will be required to allow the tunnel process to progress.

If, however, the tunnel must be driven through areas where pockets or strata of pervious material are present in the plenum area, problems with the ingress of sand and water into the plenum area act to impede the tunnelling process.

Pervious materials can cause problems for either of two reasons. In cases where the pervious material allows the air to flow directly to the atmosphere the pressure in the tunnel continuously escapes because the air leaks out, hitherto the only remedy has been to increase the air supply to the tunnel until the supply belances the leakage at the desired pressure. In cases where the pervious materials are totally enclosed by impervious materials, the pervious formation can fill up with air so that the air acts on the water within for formation and allows it to flow into the tunnel, no good solution has been found for this second problem in shield driven tunnels. Tunnellers have had to rely on various methods of face breasting with planks, straw, and other materials to restrain the flow.

SUMMARY OF THE INVENTION

This invention seeks to ameliorate and in some instances eliminate the problem of ingress of water and silt from the pervious strata during the driving of subterranean tunnels, and to control the air pressure and air consumption which have been characteristic of these tunnels. Basically, the invention accomplishes its end by the use of a liner which is pervious to water and air but impervious to soil and sand. This is accomplished by providing a liner member for the tunnel which is provided with a recess in the face thereof, which is exposed to soil for the passage of moisture therethrough. The recess will be provided with a foraminous substance in the form of a soil filter to allow the passage of water and air therethrough, but of a small enough size to prevent soil particles from passing therethrough.

In order to allow easy passage from the filter medium to the opposite side of the liner member, a plurality of channels are provided in the recess beneath the filter medium which are connected to the through passage(s) which allow the water to pass through the tunnel liner member. The through passages are connected to a suction line, that is, a system of conduits, the interior of which is at atmospheric pressure. Thus, the water which passes through each of the liner members of the type described above will actually be carried out of the tunnel by the plenum air pressure. The effect of this drainage will be to lower the pore pressures in the soil in contact with the specially fitted liners. This drainage and lowered pressure will improve the behavior of the soil by:

1. preventing pressurizing of pervious strata by tunnel air.
2. providing localized water table depression and hence lower air pressure requirements.
3. reducing the pore pressure differential across high working faces.

CROSS REFERENCES

1. PRACTICAL TUNNEL DRIVING by Mayo and Richardson, 1941.
2. Canadian Patent Application No. 374,777 filed Apr. 6, 1981 entitled "Improvement in the Plenum Tunnelling Process" by Michael P. McNally.

DESCRIPTION OF THE PREFERRED EMBODIMENT

Throughout this description reference will be made to a tunnel liner plate. Although the word "plate" will be used, it is understood that the plate may be a prefabricated steel plate or a cast iron plate or a formed concrete block. All the above have been successfully used as primary tunnel lining members.

Figure 1:
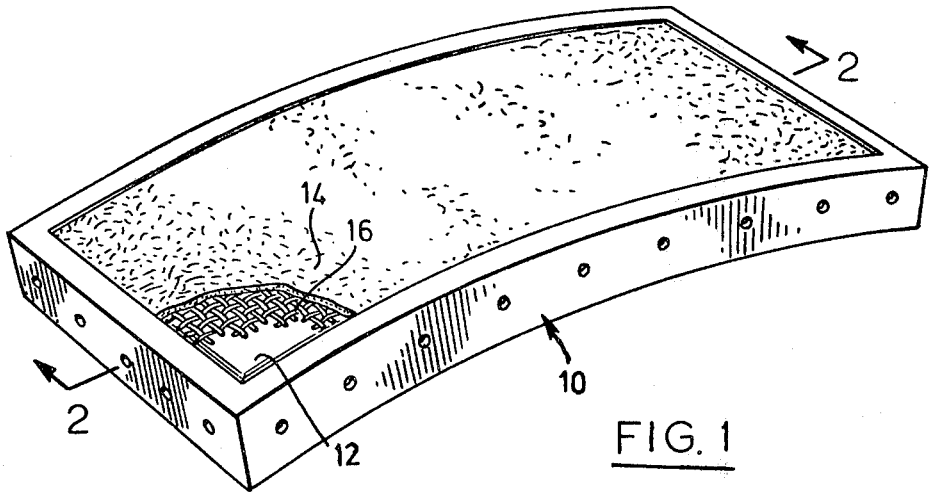
FIG. 1 is a perspective view of a liner plate which is the subject of this invention.
Figure 2:
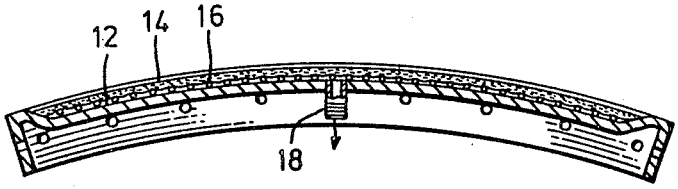
FIG. 2 is a sectional view of the liner plate of FIG. 1.

It will be seen when reference is made to the accompanying FIGS. 1 and 2 that a tunnel liner plate 10 is shown to which this invention is applied. This is a metallic plate of the usual arcuate shape to conform to the surface of the tunnel face. Suitable bolt holes are provided in the tunnel liner member for ready assemblage of the individual liner members into a complete tunnel lining.

Arcuate plate 10 is provided with a recess 12 as shown in FIG. 2 so that the central portion of the surface facing the soil is somewhat recessed. In the plate shown, the recess is of a rectangular shape and in this instance the recess covers a majority of the area exposed to the tunnel face.

A foraminous filter 14 is of a nature which permits the flow of water therethrough, but will not allow the passage of soil particles therethrough, is placed in the recess above a grillwork 16. Grillwork 16 is provided to ensure that any water which passes through filter 14 will be provided with easy passage to the outlet conduit 18. Outlet 18 is connected to the "mop" or suction line in the tunnel plenum to allow any water passed through filter 14 to escape.

In practice, the use of the liner plates of this invention are used interchangably with standard liner plates of the usual impervious nature. The plates of this invention may be interspersed as required with conventional liner plates or they may be used exclusively in the tunnel construction if the conditions warrant.

The plates of this invention may take a variety of forms as far as the filter portion of the liner is concerned. The exposed filter surface may be made to be of almost any size as long as the structural strength of the liner plate is not impaired. The filter medium may be of the treated cellulose fibers type which are widely available in a variety of pore sizes. The filter medium is preferably glued to the liner plate at the periphery thereof for ease of handling and simplicity of installation.

A grille 16 of any suitable material, i.e. plastic or wireform metal which is of a nature to provide easy passage of water passing through the filter to the exit conduit 18. Alternatively, suitable passages may be provided in the exterior surface of the liner plate by providing depressions in the liner surface for water flow from the peripheral areas to the interior of the liner plate where the exit conduit is located. It may be found in some instances that more than one exit conduit may be provided.

Figure 3:
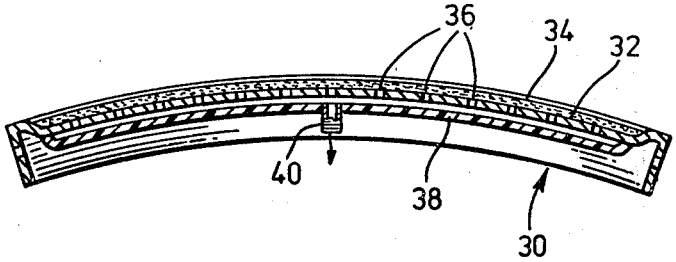
FIG. 3 shows an alternative embodiment of the invention.

In the alternate embodiment shown in FIG. 3, the liner plate 30 is provided with a recess 32 in which the foraminous filter medium 34 is glued and the recessed portion of the liner plate 34 is provided with a plurality of through holes such as the one shown at 36.

A shield 38 of a plastic or other suitable material is sealedly fitted to the inside surface of the liner plate. Conduit 40 is again connected to the mop or suction line.

Various alternatives are possible, however, applicant wishes to limit his protection only by the scope of the following claims.

I claim:

1. A tunnel lining comprising a series of similarly shaped tunnel liner members each being of a similar geometric shape such that when assembled with one another they form a continuous tunnel lining, said members being curved to conform to the shape of the tunnel, said members having exposed exterior and interior surfaces, each member having an edge surface of substantial width extending inwardly substantially orthogonally from said exterior surface, and extending around the periphery thereof to facilitate the coupling of adjacent lining members, in the construction of said lining, at least a portion of said members having a recess formed in the exterior surface of said member, a suitable filter means located in said recess to allow the passage of selected filtrate therethrough, said filter means permitting the passage of water and air therethrough, but preventing the passage of soil particles therethrough, conduit means passing through said member serving to communicate the recess in the exterior surface of said member with the interior surface of said member.

2. A tunnel liner member as claimed in claim 1 wherein said member is provided with collection means beneath said filter means, for assisting the flow of filtrate from said filter means to said conduit means.

3. A tunnel liner member as claimed in claim 1 wherein said conduit means comprises a pipe sealedly joined to said member such that any filtrate collected on the exterior surface of said liner member is free to pass into said pipe for passage through said liner member.

4. A tunnel liner plate as claimed in claim 1 for the establishment of a pressure differential between the interior and exterior surfaces of said liner plate, filter means recessed into a cavity in the exterior surface of said liner plate, conduit means passing through said plate serving to connect said cavity on said exterior surface to a source of pressure less than the pressure existing on the interior of said liner plate.

5. A tunnel liner member of a predetermined geometric shape and having an edge surface of substantial width extending around the periphery of said member and being of such shape that when each member is assembled and joined to its similarly shaped adjacent member, the resultant construction forms a primary lining of a large subterranean tunnel, the edge surfaces of said member being suitable for abutment against and fastening to adjacent previously installed liner members by means of suitable fastening means, said member having a depression formed in the exterior surface of said member, suitable filter means being located in said depression to allow the passage of a selected filtrate therethrough, conduit means serving to connect the depression to the interior surface of said member for collection of any filtrate passing through said filter means.

6. A liner member as claimed in claim 5 wherein said conduit means comprises many through holes passing through said liner plate, said through holes serving to connect said depression to said collection means.

7. A liner plate as claimed in claim 6 wherein said collection means is provided with a suitable outlet so as to be connected to a suitable pipe for the passage of filtrate therethrough.

8. A method of constructing a large subterranean tunnel in locations where the tunnel must pass through regions where the ingress of water and silt would generally present a serious impediment to the construction of a tunnel in such regions, comprising:

(a) the constant removal of a material from the tunnel face by suitable means to provide an excavated space, and (b) maintaining the evacuated part of the tunnel a closed plenum, (c) supplying compressed air to the plenum so that the air pressure in the plenum is substantially greater than atmospheric, and (d) constructing a lining in the most recently excavated part of the excavation, said lining being constructed by securing suitable lining members to similarly shaped lining members already installed in the previously excavated part of the tunnel, each lining member having an exterior surface which is an arcuate shape and having edges of substantial width extending substantially orthogonally to and around the periphery of each member to facilitate installation of lining members to previously installed lining members, at least some of the lining members having suitable filter means installed in a depression in the outer surface thereof, and (e) conduit means passing through said some of the lining members serving to connect the depression to a source of air pressure such that the air pressure existing at the depression is substantially less than the pressure existing in said plenum, so that any water passing through said filter will pass into said conduit.

* * * * *